United States Patent [19]

Siczek

[11] 3,957,399

[45] May 18, 1976

[54] DIAPHRAGM PUMP

[75] Inventor: Bernard Siczek, La Grange Park, Ill.

[73] Assignee: Graco Inc., Minneapolis, Minn.

[22] Filed: Mar. 20, 1975

[21] Appl. No.: 560,210

[52] U.S. Cl. ..... 417/387; 417/388

[51] Int. Cl.[2] ..... F04B 9/10

[58] Field of Search ..... 417/383, 387, 388, 384

[56] References Cited

UNITED STATES PATENTS

| | | | |
|---|---|---|---|
| 2,301,407 | 11/1942 | Houser et al. | 417/499 |
| 2,506,235 | 5/1950 | Nicolls | 417/387 |
| 2,821,926 | 2/1958 | Miller et al. | 417/499 |
| 3,277,829 | 10/1966 | Borgert | 417/387 |
| 3,659,969 | 5/1972 | Brituin | 417/499 |
| 3,680,789 | 8/1972 | Wagner | 417/387 |

FOREIGN PATENTS OR APPLICATIONS

| | | | |
|---|---|---|---|
| 1,137,628 | 10/1962 | Germany | 417/387 |
| 414,017 | 11/1944 | Italy | 417/499 |

*Primary Examiner*—William L. Freeh
*Attorney, Agent, or Firm*—Paul L. Sjoquist

[57] ABSTRACT

A diaphragm pump apparatus is disclosed, having a mechanically reciprocated piston driving a hydraulic fluid chamber and reciprocating a flexible diaphragm. The apparatus includes a spring-biased expansion volume connected to the hydraulic fluid chamber and a hydraulic fluid replenishing port that opens on predetermined conditions of pressure loading and piston stroke position.

16 Claims, 8 Drawing Figures

FIG. 1
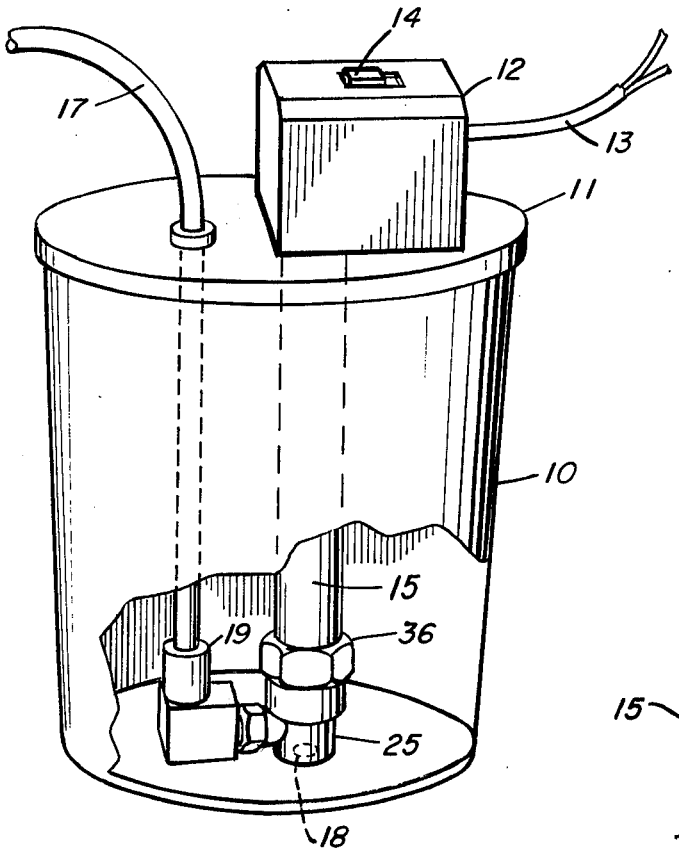
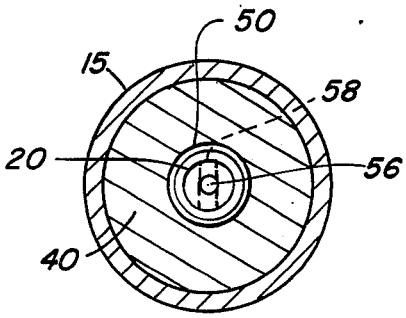
FIG. 4
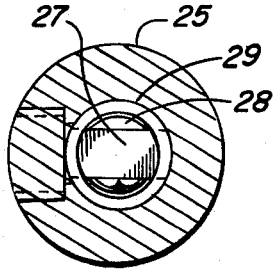
FIG. 3
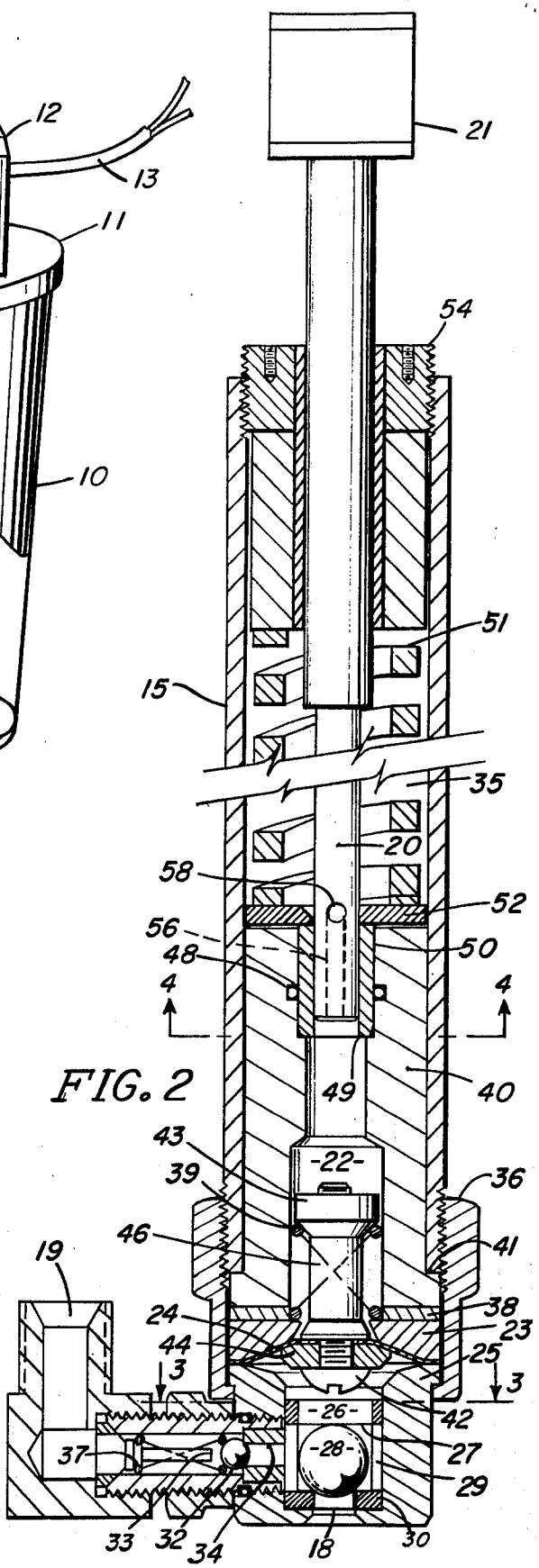
FIG. 2

DIAPHRAGM PUMP

BACKGROUND OF THE INVENTION

This invention relates to diaphragm pump apparatus, and particularly to a diaphragm pump apparatus wherein a mechanically driven piston provides a compressing force to a hydraulically driving fluid and this force is transmitted to a pumped liquid via a diaphragm assembly.

Prior art diaphragm pumps have had to solve the problem of controlling the hydraulic fluid supply to the chamber wherein the mechanical driving piston reciprocates, for the purpose of controlling the range of hydraulic fluid pressures which are developed. Since these hydraulic fluid pressures are transmitted to a diaphragm membrane which is typically of flexible and rather delicate construction, pumps of this type must be designed to guard against pressure imbalance across the diaphragm membrane. When fluid pressure imbalance across the diaphragm exceeds only a few pounds per square inch (p.s.i.) there is a danger that the diaphragm will rupture, resulting in a failure of the pumping mechanism. Further, since a great advantage of a diaphragm pump is that it enables complete isolation of the pumped fluid from the pumping chamber and mechanical parts of the pump, diaphragm rupture results in contamination of the pumped fluid with hydraulic pumping fluid or oil. Thus, not only will a diaphragm pressure imbalance result in a failure of the pumping apparatus, but also it will result in the contamination of the fluid being pumped and the internal parts of the pump itself.

There are two situations in which control over the pumping fluid pressure must be made. The first of these situations occurs when the fluid being pumped becomes pressure blocked and causes the reciprocating piston to work against excess pressure on the hydraulic fluid side of the diaphragm. In this situation the hydraulic fluid chamber must provide a relief means for bleeding off hydraulic fluid during the reciprocating piston compression stroke. The second situation occurs because of leakage from the hydraulic fluid chamber due to normal clearances, etc., and requires that hydraulic fluid be replenished into the chamber in order to maintain a sufficient quantity of hydraulic fluid for pumping to occur. The situation is typically handled by providing some sort of valving mechanism between a hydraulic fluid reservoir and the pumping chamber so that hydraulic fluid may be fed into the pumping chamber, either during the suction stroke of the reciprocating piston or whenever a predetermined negative pressure differential exists between the reservoir and the pumping chamber.

Prior art diaphragm pumps have solved the problem of relieving excess hydraulic fluid pressure under blocked pressure conditions of the pumped fluid by means of various valving mechanisms. Included among these have been spring-biased ball check valves, poppet valve assemblies, reed valves and other pressure-operated valves which unload the hydraulic fluid chamber under predetermined pressure conditions. The problem of replenishing hydraulic fluid into the pumping chamber has been solved by prior art devices using similar pressure relief mechanisms, some of which have been dependent upon piston stroke position of the mechanical driving apparatus. The present invention solves the problem of controlling hydraulic fluid chamber pressure in a new and novel way which is not found in the prior art.

SUMMARY OF THE INVENTION

The apparatus of this invention utilizes a mechanically reciprocated piston which operates in a pumping chamber filled with hydraulic oil. The pumping chamber is separated from a pumped fluid chamber by a diaphragm membrane, and the pumped fluid chamber has suitable check valves for admitting and expelling pumped fluid. Hydraulic oil is replenished into the pumping chamber by means of a passage in the reciprocating piston, which may, under certain conditions, come into hydraulic oil coupling alignment via a port to the hydraulic oil reservoir during the suction stroke of the piston. Excess hydraulic oil pressure is controlled by means of a spring-loaded variable volume mechanism which increases the pumping chamber volume under conditions of excess hydraulic pressure. The variable volume feature is controllably actuated by means of a bushing which is slidably fitted over the reciprocating piston, and which also controls the oil replenishing port to the hydraulic oil reservoir.

A secondary novel feature of the present invention is the construction of the check valves in the pumped fluid chamber. A novel ball check is disclosed for insuring positive action and return of the ball check valve.

The invention is capable of simple and compact construction, and is preferably intended for pumping paints and similar liquids, including water, at volumes in the range of 0.125 to 0.2 gallons per minute, and at pressures in the range of 1000 to 2000 p.s.i. However, the principles employed in the preferred embodiment disclosed herein are equally adaptable to the design of pumps of greater or lesser design capacities.

BRIEF DESCRIPTION OF THE DRAWINGS

A preferred embodiment of the present invention is illustrated in the drawings, in which:

FIG. 1 illustrates the invention installed on a container in position for pumping fluids contained therein;

FIG. 2 illustrates the invention in side view and partial cross-section;

FIG. 3 shows the construction cross-section along the lines 3—3 of FIG. 2;

FIG. 4 shows the construction cross-section along the lines 3—3 in FIG. 2; and

DESCRIPTION OF THE PREFERRED EMBODIMENT

Figure 5D:
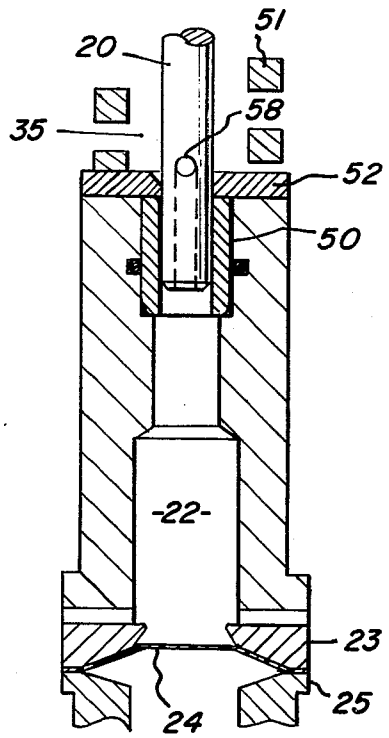
FIG. 5 illustrates the operation of the invention under each of four conditions of pressure and fluid delivery.

Referring first to FIG. 1, the invention is shown in a typical installation for pumping fluids from a container 10 through a delivery line 17. A power source 12 develops a reciprocating drive motion which is mechanically coupled to the invention housed in pump housing 15. Power source 12 may typically be a reciprocating electric motor which is operable by means of a switch 14 and receives its power through an electric cord 13. One of the power source embodiments which applicant has found suitable for use with the invention is the power source designed for use with the common household or industrial portable sabre saw. This type of power source typically operates at a reciprocating speed of about 2,000 revolutions per minute (rpm) and provides sufficient drive force for the present invention.

The power source 12 and pump housing 15, as well as the delivery line 17 outlet are all securely attached to a cover 11 which is seated over container 10. Pump housing 15 contains the invention to be hereinafter described, and receives container 10 liquid through an inlet 18 and expells the liquid through an outlet 19 at an elevated pressure in range of 1000–2000 p.s.i. Delivery line 17 is typically connected to a delivery nozzle of conventional design and may, for example, be a paint spray gun in the case of a paint pumping system.

Referring next to FIG. 2, the invention is shown in side view and in cross section. An elongated piston rod 20 is mechanically coupled to the reciprocating power source via a suitable coupler 21. Piston 20 projects downwardly and reciprocates in pumping chamber 22, which is filled with a suitable hydraulic oil. The reciprocation of piston 20 causes diaphragm 24 to reciprocate, thereby creating a pumping action in pump chamber 26. During the suction stroke of piston 20 diaphragm 24 moves upwardly and ball check 28 is lifted from its seat 30 to draw fluid into inlet 18. During the compression stroke of piston 20, diaphragm 24 is forced downwardly and ball check 32 is forced from its seat 34, thereby expelling liquid from pump chamber 26 out through pump outlet 19. The above operation is typical of diaphragm pumps found in the prior art and is described herein as an introductory explanation of the basic pump operation.

Diaphragm 24 is preferably constructed of a nylon membrane of approximately 0.020 inches in thickness. Diaphragm 24 is held in place by means of diaphragm retainers 23 and 25. Retainer 25 is secured against the end of pump housing 15 by means of a threaded retaining nut 36. Retaining nut 36 is tightened to compress retainer 23 and 25 around the outer circumference of diaphragm 24 and thereby hold it securely in place. A urethane washer 38, which has some limited compressibility, is positioned between retainer 23 and interior housing 40 to provide a locking force which maintains the diaphragm tightly secured.

Diaphragm 24 is associated with an assembly clamped together by cap screw 42 and square nut 43. The assembly consists of a stop 44 mounted on the pump chamber side of diaphragm 24, and a spacer 46 mounted on the pumping chamber side of diaphragm 24. A compression spring 39 is installed between square nut 43 and a shoulder created by a projection of retainer 23. Spring 39 serves to exert an upward bias against diaphragm 24 to assist it in its pumping action during the suction stroke of piston 20. It is particularly important in cases where pump chamber 26 has lost its prime, enabling the diaphragm to maintain a pumping action. Stop 44 has an annular beveled shoulder which is complementary shaped to a shoulder on retainer 25. The mating of these two shoulders provides an absolute mechanical stop to limit the maximum downward excursion of diaphragm 24 and thereby prevent diaphragm rupture in cases where pump chamber 26 is empty of fluid.

Interior housing 40 is securely held against the end of pump housing 15 by means of a shoulder 41 which overhangs the edge of the pump housing. Thus, retaining nut 36 not only clamps the diaphragm assembly securely in place inside of pump housing 15, but also clamps interior housing 40 in place. A threaded cap 54 is adjustably positioned at the top end of pump housing 15. Cap 54 compresses a heavy spring 51 downwardly against washer 52, which in turn rests on the top surface of interior housing 40. Cap 54 may be threaded inwardly or outwardly to adjust the spring compression of spring 51 for purposes which will be hereinafter described.

A slidable sleeve 50 is positioned in interior housing 40 over the lower portion of piston 20. The sleeve 50 is sized so as to have an annular edge 49 exposed to the interior of pumping chamber 22. The upper edge of sleeve 50 abuts against washer 52, so that upward motion of sleeve 50 causes spring 51 to compress.

The bottom surface of piston 20 has a port opening into passage 56. Passage 56 is drilled a distance into piston 20 to contact a port 58, which may be a transverse hole drilled through piston 20. The relative position of port 58 is such that it clears the upper edge of washer 52 and sleeve 50 when piston 20 is at the extreme of its suction stroke, assuming washer 20 to be seated against interior housing 40. In this position an oil communication path is formed between oil reservoir 35, port 58 and passage 56, and pumping chamber 22. During the compression stroke of piston 20, port 58 is covered by sleeve 50, thereby closing the communication path between all reservoir 35 and pumping chamber 22.

FIG. 4 illustrates a sectional view of the apparatus taken along the lines 4—4 of FIG. 2. Sleeve 50 is in mating but sliding contact with interior housing 40 and piston 20, and O-ring 48 provides an oil seal for minimizing the oil loss between sleeve 50 and interior housing 40. Passage 56 is drilled into the end surface of piston 20 as hereinbefore described. The cross-sectional area of a portion of the edge surface of sleeve 50 is exposed to pressures developed in pumping chamber 22, and these pressures cause an upward force to be directed against the sleeve edge which acts in opposition to the downward force of spring 51. At some predetermined pumping chamber 22 pressure these forces come into balance, and any further increase in pumping chamber 22 pressure will cause sleeve 50 to rise. Once sleeve 50 begins to rise the entire cross-sectional area of its annular edge surface becomes exposed to the pressure forces in pumping chamber 22, and sleeve 50 continues to rise until a new balance is achieved with the spring force of spring 51.

FIG. 2 also illustrates in partial cross section the valving mechanism associated with pump chamber 26. Ball check 28 is seated on seat 30 and is held in a seated position by leaf spring 27. Leaf spring 27 is positioned across a pair of notches formed in cylindrical spacer 29. During the suction stroke of piston 20 and diaphragm 24, fluid is drawn into inlet 18, causing ball check 28 to lift from its seat 30 in opposition to the spring force of leaf spring 27. At the end of the suction stroke leaf spring 27 snaps ball check 28 back unto its seat 30 and closes off the inlet 18. During the compression stroke of piston 20 and diaphragm 24, ball check 32 is forced from its seat 34 to provide a fluid flow path from pump chamber 26 to outlet 19. The movement of ball check 32 is limited by stop 33, and it is seated by compression spring 37.

FIG. 3 shows the construction of ball check 28 in partial cross section along the lines 3—3 of FIG. 2. It can be seen that a fluid flow path exists around ball check 28, because of the construction of leaf spring 27 and spacer 29. Leaf spring 27 offers an advantageous valving mechanism, in that it provides a snap action closing force to force ball check 28 back unto its seat 30 after it has become unseated.

Under normal operating conditions, a quantity of pumped liquid is admitted into chamber 26 during each suction stroke of piston 20. This pumped fluid is ejected from pump chamber 26 during each compression stroke of piston 20. An adequate supply of hydraulic oil is assured to pumping chamber 22 because port 58 becomes exposed to the hydraulic oil reservoir 35 during each suction stroke. This allows oil to be replenished to pumping chamber 22 during each suction stroke of the piston to compensate for oil leakage around piston 20.

Should the pump chamber 26 become emptied of fluid diaphragm 24 will be forced downward during the compression stroke until the annular shoulder of stop 44 contacts the mating shoulder of retainer 25. This will limit any excess diaphragm motion and thereby preserve the diaphragm against damage.

Should the delivery line from outlet 19 become blocked, pump chamber 26 will be filled with pumped fluid, and this will act to restrain any diaphragm motion during the compression stroke of piston 20. However, since piston 20 is mechanically reciprocated it will continue to move downward during its compression stroke, developing an increasing hydraulic pressure in pumping chamber 22. When this hydraulic pressure reaches a predetermined value it acts against the exposed annular edge 49 of sleeve 50 to force sleeve 50 upward against spring 51. As sleeve 51 moves upward its void creates an expanded volume of pumping chamber 22 to enable hydraulic fluid to fill the void without increasing pressure further. Moreover, once sleeve 50 has lifted from its seat adjacent edge 49, the entire annular edge area of sleeve 50 becomes exposed to pumping chamber 22 hydraulic pressures. This causes sleeve 50 to be held in an upward position under a reduced hydraulic pressure in pumping chamber 22. The effect is to stabilize hydraulic pressure in pumping chamber 22 at a predetermined nominal level-less than that required for the initial lifting of sleeve 50. Sleeve 50 will remain unseated for so long as this nominal hydraulic pressure exists in pumping chamber 22. It should be noted that, for so long as sleeve 50 is in its raised or lifted position, replenishing port 58 is covered to prevent further hydraulic oil from draining from oil reservoir 35 into pumping chamber 22. Thus, under blocked output pressure conditions, sleeve 50 slides to create an expanded volume in pumping chamber 22 and thereby provides expansion volume for hydraulic oil forced into pumping chamber 22 by piston 20, and also closes replenishing port 58.

Figure 5C:
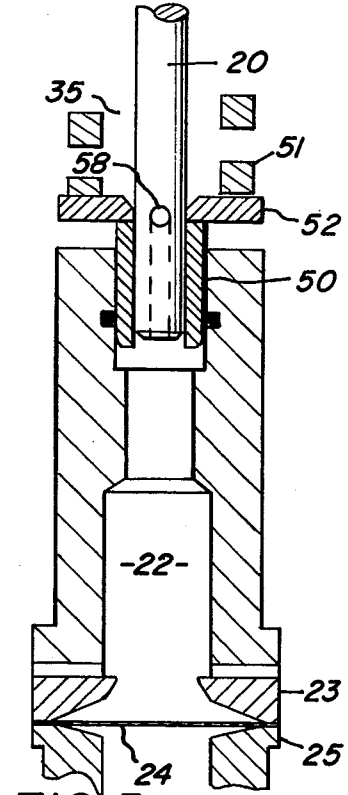
Figure 5B:
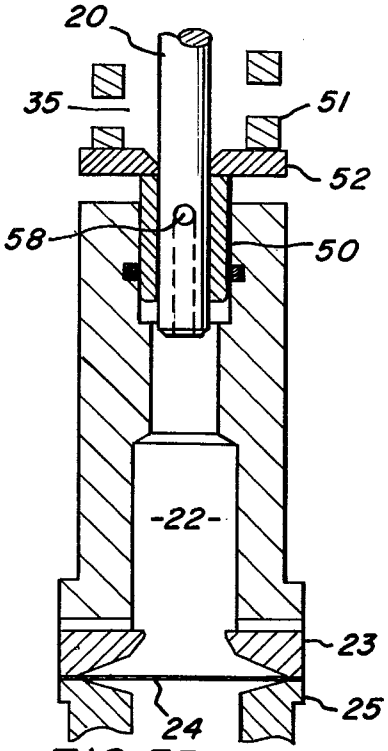
Figure 5A:
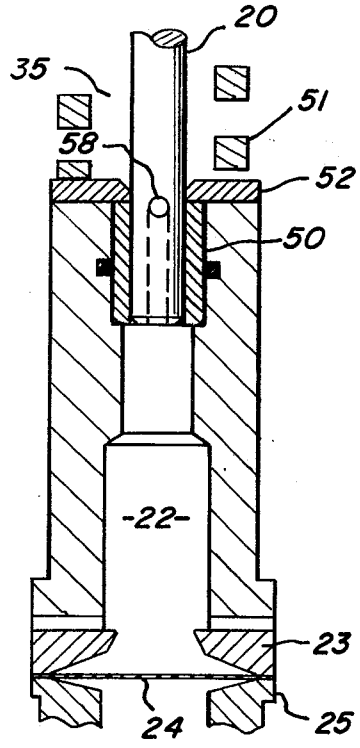

FIG. 5 illustrates, in simplified schematic form, the several operating conditions of the apparatus. In FIG. 5A, it is assumed that the outlet pressure is blocked and piston 20 is moving downward in its compression stroke. As piston 20 reaches the end ot its compression stroke (FIG. 5B) sleeve 50 slides upwardly, raising washer 52 and compressing spring 51. The blocked pressure condition is further illustrated by showing diaphragm 24 in a non-moving horizontal position. In FIG. 5C piston 20 has traveled through its suction stroke and is ready to begin another compression stroke. Port 58 has not opened into oil reservoir 35 during any portion of the compression or suction strokes because of the raised position of sleeve 50. FIG. 5D shows the same relative position of piston 20 under conditions where outlet pressure is unblocked. This is the so called "normal" operating condition wherein sleeve 50 is seated and compression spring 51 is fully extended. Under these conditions port 58 becomes exposed to oil reservoir 35 and provides a path for oil to be replenished into pumping chamber 22.

It should be understood that FIG. 5 is diagrammatically representative of the operation of the invention, and is not necessarily drawn to scale. The stroke positions and movement of the various components is exaggerated to illustrate the operational effect of the invention.

Having described herein a preferred embodiment of the invention, it is apparent that various changes in construction details may be made without departing from the spirit of the invention.

What is claimed is:

1. A diaphragm pump apparatus of the type having a mechanically reciprocating piston for alternately compressing and relaxing a driving fluid chamber acting on one side of a diaphragm and having a pumped fluid chamber on the other side of the diaphragm, comprising a. a sleeve slidable over said piston and having at least a portion of its first edge surface area exposed to the driving fluid chamber, and having its second edge surface positioned outside said driving fluid chamber;

b. spring-biasing means for urging against said second edge surface and biasing said sleeve toward said driving fluid chamber;

c. a mechanical stop for limiting the movement of said sleeve toward said driving fluid chamber;

d. a driving fluid reservoir in fluid coupling contact with said piston outside said driving fluid chamber;

e. a replenishing passage through said piston and opening at a first point into said driving chamber and at a second point along said piston, whereby said second point may contact said driving fluid reservoir during a portion of said piston reciprocating stroke, and whereby said sleeve is slidable into closing relationship over said second point.

2. The apparatus of claim 1, further comprising means for adjusting the relative spring force of said spring-biasing means.

3. The apparatus of claim 2 wherein said driving fluid chamber, in the region adjacent said sleeve first edge surface, has a dimension greater than said sleeve inner diameter but less than said sleeve outer diameter.

4. The apparatus of claim 3 wherein said spring-biasing means further comprises a compression spring axially surrounding said piston.

5. The apparatus of claim 4 wherein said driving fluid reservoir encompasses said compression spring.

6. The apparatus of claim 5, further comprising a spacer interposed between said compression spring and said sleeve second edge surface.

7. The apparatus of claim 6, further comprising an O-ring fluid sealer surrounding said sleeve.

8. The apparatus of claim 7, wherein said replenishing passage further comprise a first portion in axial alignment with said piston and a second portion communicating therewith in transverse alignment with said piston.

9. A diaphragm pump pressure relief apparatus for preventing hydraulic pressures in the diaphragm pumping chamber from exceeding a predetermined and adjustable amount, comprising;

a reciprocable piston operably connected into the diaphragm pumping chamber for developing hydraulic pressure;

a sleeve slidably fitted over said piston and having at least a portion of its end surface area exposed to pressures developed in said pumping chamber;

a biasing means for urging against said sleeve and for opposing hydraulic pressure forces developed against said sleeve end surface area; and means for slidably seating said sleeve in relation to said pumping chamber, said seating means having a stop for limiting the minimum separation of said sleeve relative to said pumping chamber.

10. The apparatus of claim 9, further comprising means for adjusting the force exerted by said biasing means.

11. The apparatus of claim 10, further comprising a passage in said piston extending between a piston surface contacting said pumping chamber and a piston surface which may be reciprocably covered and uncovered by said sleeve.

12. The apparatus of claim 11, wherein said sleeve has a length sufficient to slidably cover said passage under all piston reciprocating positions.

13. The apparatus of claim 12, further comprising a hydraulic fluid reservoir adjacent said pumping chamber and enclosing at least a portion of said piston, said reservoir having an opening for reciprocating said piston from outside said reservoir.

14. The apparatus of claim 13, wherein said biasing means is enclosed within said reservoir.

15. The apparatus of claim 14, wherein said means for adjusting the force exerted by said biasing means is at least partially and adjustably external to said reservoir.

16. The apparatus of claim 15, wherein said biasing means further comprises a compression spring.

* * * * *